United States Patent [19]

Sheldon, Jr.

[11] 4,032,147

[45] June 28, 1977

[54] COMPOSITE DART BODY

[75] Inventor: Walter M. Sheldon, Jr., Deerfield, Ill.

[73] Assignee: Fansteel Inc., North Chicago, Ill.

[22] Filed: May 17, 1976

[21] Appl. No.: 687,168

[52] U.S. Cl. ..... 273/106.5 R

[51] Int. Cl.[2] ..... A63B 65/02

[58] Field of Search ..... 273/106.5 R; 29/191–191.6

[56] References Cited

UNITED STATES PATENTS 2,305,555 12/1942 Peters et al. ..... 29/191.6 X

FOREIGN PATENTS OR APPLICATIONS 479,525 2/1938 United Kingdom ..... 273/106.5 R
506,176 5/1939 United Kingdom ..... 273/106.5 R
510,193 7/1939 United Kingdom ..... 273/106.5 R

*Primary Examiner*—Paul E. Shapiro
*Attorney, Agent, or Firm*—Barnes, Kisselle, Raisch & Choate

[57] ABSTRACT

A novel composite dart body having an unusually high mass to diameter ratio is provided comprising a central body portion of high density metal having a density of at least 18.5 g/cm$^3$ bonded to front and rear body ends of readily machinable materials.

10 Claims, 2 Drawing Figures

COMPOSITE DART BODY

BACKGROUND OF THE INVENTION

Figure 1:
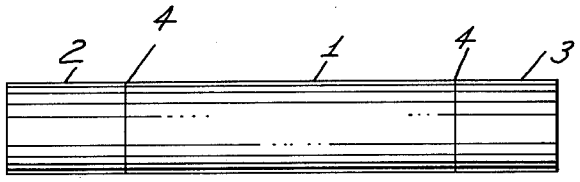

This invention relates to a Composite Dart Body having a high weight to volume composite body construction that provides superior performance in several applications, especially in darts. The invention also provides a method for making the improved body construction.

State-of-the-art darts are produced in a wide range of shapes and designs, and are constructed from a number of materials, both metallic and non-metallic. Easily machined materials such as copper-base alloys, particularly various grades of brass, are commonly used to provide a relatively low cost construction, free machining characteristics, adequate resistance to corrosion from the atmosphere and from human contact, and for esthetic appearance.

In some darts of more advanced state-of-the-art, higher density materials such as sintered tungsten-copper alloys have been utilized to produce darts with slimmer or smaller diameter bodies for a given desired weight of dart. These so-called tungsten-copper alloys (or tungsten-nickel, tungsten-copper-nickel, tungsten-nickel-iron, or similar materials) are not true alloys, but can be more correctly described as liquid-phase sintered composites in which the tungsten particles are infiltrated and surrounded by a matrix of copper, nickel, copper-nickel, nickel-iron, or other similar lower melting point binder. Darts have been constructed using bodies of these tungsten heavy metal alloys containing up to a maximum of about 90–95% tungsten content, balance binder metals. More typically, materials such as 70% tungsten and 30% copper and similar tungsten-base materials have been used. These tungsten heavy metals are machinable so they can be drilled and tapped to receive the point of the dart at the front, and the tail feather assembly at the rear of the dart body by means of threaded connections. In some cases, the heavy metal bodies have been bonded by techniques such as adhesive bonding to the point and tail feather assembly to make the complete dart.

These tungsten heavy metal bodies do provide a dart with a generally desired slimmer body for a given desired weight, but since they are produced by sintering, variations in density and a resulting imbalance can occur in the sintered parts because of density variations produced in pressing or molding the original part before sintering, or from density variations resulting from the much higher density of tungsten than of the binder metals. For example, in Military Specification "Tungsten Base, High Density Metal (Sintered or Hot Pressed)", MIL-T-21014B(ASG), Amendment 1, June 9, 1961, Class 1 Material contains approximately 90% tungsten, but the allowable density can range from 16.85 to 17.25 g/cm$^3$. In addition, the maximum density of such readible machinable heavy metal parts is limited to about 18.3 g/cm$^3$ maximum.

It is frequently desired in darts to have an asymmetrical location of the center of gravity of the dart body along its length. A dart that is "nose heavy", i.e., which has its center of gravity located toward the front portion of the dart body, has been found to exhibit improved stability in flight, and, consequently, improved accuracy. In state-of-the-art darts where the body is machined from a single material (such as brass, or tungsten heavy metals, as examples), this nose-heavy feature is achieved either by: a tapered body shape, with the largest diameter toward the front; or by drilling out material from the rear of the body. In order to achieve the desired weight in such darts, it is necessary to increase the diameter of the dart body. Also, the small diameter ends of types with a tapered body, or the drilled out portion of the end of darts of this type are weakened structurally as a consequence.

In some state-of-the-art darts, a tungsten heavy metal front piece is attached by a threaded connection to a lower density, more readily machinable material such as brass to achieve a "nose-heavy" weight distribution. However, such constructions do not provide as small a diameter body for a given desired dart weight as do the composite dart bodies of this invention.

This invention provides an improved dart body construction produced by using a dart body material with uniform density characteristics throughout the body, and having a density of at least 18.5 g/cm$^3$ and more particularly, at least 18.9 g/cm$^3$, and 19.3 g/cm$^3$ in the preferred embodiment.

One objective of this invention is to provide a dart body utilizing such high density materials that would result in a dart with a substantially diminished size for a given weight, which allows the player to throw more darts into a smaller area of the target.

A further objective is to provide a dart body that will result in less interference for subsequent darts that are thrown by the player, particularly when the earlier darts are not embedded perpendicular to the thrown arc of the darts, thus substantially improving the scoring capabilities.

Another objective is to provide a dart body resulting in improved accuracy of the darts because of their high weight to diameter ratio and weight to length ratio.

Another objective of the invention is to provide a dart with a more durable body construction than dart bodies produced from commonly used machinable materials.

Another objective is to provide a dart body offering a simplicity of assembly.

Still another objective is to provide a composite, unitized dart body construction.

Still another objective is to provide a dart giving improved accuracy because of a completely symmetrical weight distribution in the dart body because of its uniform, high density construction.

A further objective is to provide a dart giving improved accuracy by means of an asymmetrical location of the center of gravity along its length in some embodiments while still maintaining the advantages of a smaller diameter for a given weight of the dart body.

Still another additional objective is to provide a dart body having improved strength and hardness compared with state-of-the-art materials used in darts.

Other objects and features of the invention will be apparent in the following description and claims in which the invention is set forth together with a detailed explanation on how to make the product of the invention in connection with the best mode presently contemplated for the practice of the invention.

Drawings accompany the disclosure and the various views thereof may be briefly described as:

FIG. 1, an illustration of one embodiment of the invention showing a brazed composite construction utilizing a tungsten body and stainless steel front and rear body ends.

Figure 2:
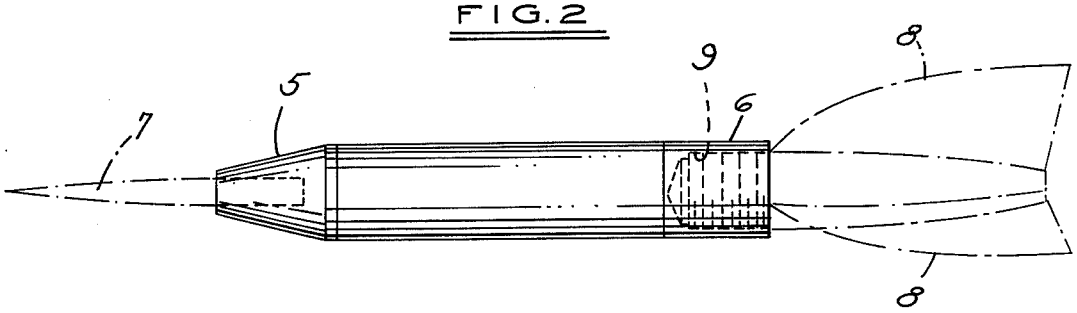

FIG. 2, an illustration of a finished dart body after brazing the assembly and machining the stainless steel front and rear body ends preparatory to receiving the point and tail feather assemblies.

A typical improved dart body of this invention is shown in FIG. 1. The central portion of body 1 is produced from cut lengths of swaged tungsten rod. Tungsten rod may be materials such as: commercially pure, unalloyed tungsten; or a doped grade of tungsten such as a lamp filament or a "non-sag" grade; or even thoriated tungsten, such as tungsten-2% thoria ($ThO_2$). These materials have densities ranging from 19.3 g/cm$^3$ for the unalloyed and doped tungsten materials to about 18.9 g/cm$^3$ for the 2% $ThO_2$ content, thoriated tungsten. High-density sintered, high purity, unalloyed tungsten also could be utilized for the central body, provided that it has a density of at least 18.5 g/cm$^3$.

Depleted uranium is another high density (18.7 to 19.07 g/cm$^3$) material that could be used either for the center body or the front and back bodies of composite dart bodies of this invention. However, it has substantially lower strength properties and hardness compared to tungsten; and depleted uranium still exhibits some radioactivity, which is an adverse consideration in its use.

Alternately, high density metals, such as rhenium (density of 21.04 g/cm$^3$) or precious metals such as gold (density of 19.32 g/cm$^3$), platinum (density of 21.45 g/cm$^3$), iridium (density of 22.5 g/cm$^3$), and osmium (density of 22.57 g/cm$^3$), or their alloys having a density greater than 18.5 g/cm$^3$), could be utilized for the center body or the end bodies, but their costs are much higher than that of the tungsten materials.

The tungsten body is bonded to the front and back pieces of a more readily machinable material, shown as 2 and 3, such as a free machining stainless steel, or brass, or heavy metal (liquidphase sintered tungsten materials) as examples. Stainless steel has been found to be an especially useful type of material for the front and back body ends. The tungsten body is bonded to the stainless steel body ends by any of several techniques such as silver brazing or adhesive bonding, although silver brazing is preferred to form the highest strength, integral and durable bond. The silver brazing is accomplished by placing wafers 4 of the brazing alloy between the tungsten body and stainless steel body ends, and brazing the composite by heating the assembly to a temperature above the flow point of the brazing material. Then the brazed assembly is finish-machined by employing a sanding or other roughing treatment on the tungsten body to produce a rough surface for gripping purposes, and the stainless steel body ends 5 and 6 are finish-machined to receive the point 7 and tail feather assembly 8. The point 7 typically is constructed from materials such as high carbon steels (Grade 1065 or still higher carbon content steels) or a stainless steel such as Grade 420. The point can be assembled into the front body end 5 by techniques such as press fitting, or by potting with materials such as a pressure sensitive anaerobic, for example, methacrylic ester as a self-hardening liquid, or other suitable high strength adhesives or sealants. The tail feather or fletching assembly normally is attached by threading into a recess 9 at the rear body end 6. Neither the point nor tail feather assemblies except in combination constitute a portion of this invention since these components are standard state-of-the-art units.

In addition to stainless steel, other readily machinable materails including copper-base alloys, such as brass and nickel-silver, or heavy metal tungsten alloys such as tungsten-copper, tungsten-nickel, tungsten-copper-nickel, and tungsten-nickel-iron and similar materials, can be utilized for the front and rear body ends as optional methods of construction for dart bodies of this invention.

When silver brazing alloys are used to make the brazed assembly, an alloy with a high flow point is desirable, and indeed is necessary to adequately wet the tungsten. When bonding the tungsten body to stainless steel body ends, use of a silver brazing alloy, designated "D" alloy, containing 65% silver, 30% copper, and 5% nickel has been found to be especially effective. This alloy has a flow point of about 1000° C. (1835° F).

As a further aid in obtaining a high quality, strong brazed bond, it has been found desirable to nickel-flash the tungsten body before brazing. This can be accomplished by nickel plating the tungsten body in a Watts-type bath to a thickness of about 0.000008–0.000015 inch, followed by a diffusion treatment at about 1000° to 1100° C., then further nickel plating to an additional thickness of 0.000008–0.000040 inch.

The tungsten body is preferably in the form of wrought tungsten rod in the as-swaged condition having a wrought, fibrous micro-structure and having a hardness of at least Rockewell C40 and preferably Rockwell C48 or higher.

EXAMPLE 1

Unalloyed tungsten rod was produced by pressing hydrogen reduced tungsten powder into a bar, sintering the bar by self-resistance heating, and hot swaging the tungsten bar to produce swaged tunsten rod, which was subsequently centerless ground to a diameter of 0.312 inch. This tungsten rod represents state-of-the-art swaged tungsten rod such as is commonly used in automotive electrical contact point applications.

A dart body of 1.125 inches length was cut from the tungsten rod. This tungsten body was assembled in a fixture by placing shims of silver brazing alloy "D" at each end of the tungsten rod, and then placing 0.416 inch length by 0.312 inch diameter type 303 stainless steel body ends at the ends of the assembly. The assembly was brazed by heating it in a furnace under an atmosphere of 75% hydrogen and 25% nitrogen to a temperature above the flow point of the silver brazing alloy. Alternately, an atmosphere of pure hydrogen can be used, or brazing can be accomplished by other heating techniques, such as by induction heating.

The brazed dart body assembly was centerless sanded to produce a rough surface finish, and the stainless steel front and back components 5 and 6 were finished machined to receive the point and tail feather assemblies.

A number of different surface finishes can be produced on dart bodies of this invention. The tungsten body can be sanded with grits of different grain sizes to achieve the desired degree of roughness for gripping purposes, or the tungsten body may be knurled or otherwise finished to produce roughened pattern finishes.

Selective oxidation treatments can be used to preferentially color either the tungsten or the stainless steel. For example, the dart body assembly can be heated in a wet hydrogen atmosphere to preferentially oxidize the stainless steel, while leaving the tungsten bright, to produce various colors on the stainless steel ranging from straw through purple to blue colors. Alternately, oxidation treatments in air can be utilized to produce various interference color films on the tungsten while leaving the stainless steel bright; or such oxidation treatments of the tungsten can be done before or after preferentially oxidizing the stainless steel. Thus, an extremely wide range of surface finishes and esthetic appearances can be produced in dart bodies of this invention to satisfy a wide variety of user's preferences.

Other dart body assemblies in accordance with the invention have been produced using similar tungsten rod center bodies, but using materials such as brass, nickel-silver, and tungsten-7% copper-4% nickel heavy metal alloy, or other similar liquidphase sintered high-tungsten materials for the front and rear bodies of this invention. For example, by using tungsten for the center body and a higher density, liquid-phase sintered tungsten material in the front and rear bodies to achieve good machinability, a composite dart body with a maximized overall density, and minimum diameter for a given desired weight can be achieved. In this embodiment, pure copper can be used as the brazing material instead of silver brazing alloys.

In other embodiments using copper-base materials such as brass for the front and rear bodies, a strong silver alloy brazed bond to the tungsten center body can be achieved by coating the ends of the tungsten center body with pure copper instead of nickel plating before silver alloy brazing the copper-base end bodies to the tungsten center body.

In additional embodiments of this invention, an asymmetrical weight distribution, such as a nose-heavy weight distribution, can be achieved in the composite dart body while still maintaining a small diameter, high-density, solid, body construction. For example, different length or weight front and rear body ends of a lower density material such as stainless steel, brass, or tungsten heavy metal can be bonded to the tungsten center body to achieve this result. In another embodiment, a lower density material such as stainless steel can be used as the rear body end and tungsten heavy metal for the front body end, both bonded to the tungsten center body, to achieve this result.

The above examples serve to illustrate the types of composite dart bodies covered by this invention, but are not limiting and are further defined in the claims.

What is claimed is:

1. An improved composite dart body for a hand throwing dart which comprises:

a. a slender, substantially cylindrical, central, metallic body having a density of 18.5 to 19.3 grams per cubic centimeter, b. a front body bonded to one end of said central body formed of a machinable metal having a recess to receive a dart point, and c. a rear body bonded to the other end of said central body formed of a machinable metal having a recess to receive a fletching assembly.

2. An improved dart body as defined in claim 1 in which the central body is composed of swaged tungsten metal.

3. An improved dart body as defined in claim 1 in which the front and rear bodies are formed of stainless steel.

4. An improved dart body as defined in claim 1 in which the front and rear bodies are formed of copper base alloys.

5. An improved dart body as defined in claim 1 in which the front and rear bodies are formed of tungsten heavy metal selected from tungsten-copper, tungsten-nickel, tungsten-copper-nickel, and tungsten-iron-nickel.

6. An improved composite dart body of claim 1 in which the front body end is constructed from a higher density, readily machinable metal or alloy then the readily machinable metal or alloy used in the rear body end to provide an asymmetrical location of the center of gravity along the length of the assembly.

7. An improved dart body as defined in claim 1 in which the front and rear bodies are selectively and respectively formed of tungsten heavy metal and stainless steel.

8. An improved dart body as defined in claim 1 in which the front and rear bodies are selectively and respectively formed of tungsten heavy metal and a lighter readily machinable metal.

9. An improved dart body as defined in claim 1 in which the front and rear bodies are selectively oxidized to produce color oxides on the surfaces.

10. An improved dart body as defined in claim 1 in which the central body is formed of a metal selected from depleted uranium, rhenium, gold, platinum, iridium and osmium.

* * * * *